United States Patent [19]

Eckert

[11] 4,216,599

[45] Aug. 12, 1980

[54] ADJUSTABLE ALPHABETIC OR NUMERIC DISPLAY DEVICE

[75] Inventor: Ronald P. Eckert, Northbrook, Ill.

[73] Assignee: Thomas A. Schutz Co., Inc., Morton Grove, Ill.

[21] Appl. No.: 942,940

[22] Filed: Sep. 18, 1978

[51] Int. Cl.[2] ..... G09F 13/06

[52] U.S. Cl. ..... 40/451; 40/576; 40/579

[58] Field of Search ..... 40/579, 580, 576, 577, 40/447, 450, 451, 574–575, 488, 490, 491, 434; 340/755, 756, 757

[56] References Cited

U.S. PATENT DOCUMENTS

| | | | |
|---|---|---|---|
| 1,775,151 | 9/1930 | Auerbach | 40/576 |
| 2,247,939 | 7/1941 | Bunny | 40/579 X |
| 2,263,281 | 11/1941 | Von Tadden | 340/756 X |
| 2,765,458 | 10/1956 | Hoover | 340/756 X |
| 2,770,061 | 11/1956 | Marcy | 340/756 X |
| 3,106,029 | 10/1963 | Desmond | 40/491 X |
| 3,200,396 | 8/1965 | Stevens et al. | 340/378 |
| 3,344,544 | 10/1967 | Hellen | 40/493 |
| 3,399,475 | 9/1968 | Rinder | 40/451 |
| 3,444,319 | 5/1969 | Artzt et al. | 340/756 X |
| 3,444,552 | 5/1969 | Feigin | 340/379 |
| 3,831,303 | 8/1974 | Funaki | 40/450 |
| 3,939,584 | 2/1976 | Trame | 40/576 X |
| 3,961,432 | 6/1976 | Wakabayashi | 40/452 |
| 4,047,314 | 9/1977 | Slack et al. | 40/447 |
| 4,064,503 | 12/1977 | Saylor et al. | 40/447 X |

*Primary Examiner*—John F. Pitrelli
*Assistant Examiner*—G. Lee Skillington
*Attorney, Agent, or Firm*—Wegner, Stellman, McCord, Wiles & Wood

[57] ABSTRACT

A device for selectively displaying alphabetic or numeric characters has a housing which contains several stacked prefabricated subassemblies of any required number of units, each unit having an opaque front plate with a rectangular layout of light permeable spots; and there are film receiving slots with guides at both sides of each unit so that a selected part of a film member associated with a unit may abut the front plate while the rest of the film member is curved rearwardly through the slots. One type of film member has a geometric pattern of matching and contrasting elements which cooperate with light permeable spots forming a block number 8 to define any desired arabic numeral from 0 to 9; while another type of film member has a similar geometric pattern that cooperates with light permeable spots in several parallel vertical columns to define any letter of the alphabet. In either case, several matching and contrasting elements define parts of more than one character, so the film member is relatively short; and index numbers or letters along the top of the film member cooperate with an index element on the housing to visually indicate when a desired numeral or letter is defined.

37 Claims, 11 Drawing Figures

ADJUSTABLE ALPHABETIC OR NUMERIC DISPLAY DEVICE

BACKGROUND OF THE INVENTION

There are many types of stores in which it is desirable to be able to set up an attractive price display on which the prices of articles may be shown, with the names of the articles and their indicated prices being inaccessible to unauthorized persons, but being readily shifted when required. In some cases only a shiftable price display is needed, while in others both the identified articles and the prices need to be changed.

A type of shiftable price display using pre-curled plastic film tapes bearing arabic numerals is disclosed in U.S. Pat. No. 3,939,584. Each of the self-coiling plastic tapes in the device of the patent must be long enough for the individual arabic numerals from 0 through 9 to be displayed separately. This requires a relatively long plastic tape, and restricts the size of the numerals in order to eliminate the need for an excessively long tape. Such a tape for the twenty six letters of the English alphabet is almost prohibitively long.

A number of workers in the prior art have developed apparatus which uses an opaque baseplate with a transparent arabic number 8 on it, in combination with a shiftable mask which cooperates with the arabic number 8 to define any desired arabic numeral from 0 through 9. Various designs of such shiftable masks have been developed which make it possible for the mask to be much smaller than ten times the size of the number 8, because the same opaque and transparent elements may be utilized to form parts of more than one of the numerals. Such mechanisms are illustrated in U.S. Pat. No. 4,047,314 for a digital readout clock; U.S. Pat. No. 3,344,544 for an alpha-numeric display device; U.S. Pat. No. 3,831,303; U.S. Pat. No. 3,444,552 which has characters arranged in a scrambled pattern on a circular surface; and U.S. Pat. No. 3,961,432 which discloses a figure 8 mask much like the one in the present invention. Some of the prior art patents use a single shutter member, while others use multiple shutter members one behind the other.

The prior art includes devices which define numbers or letters by means of transmitted light and others which define them by means of reflected light.

Except for the self coiling tape apparatus, all of the prior art devices are relatively complex and correspondingly expensive.

SUMMARY OF THE INVENTION

The present apparatus utilizes a unit with an opaque front plate having a rectangular layout of light permeable spots, in combination with a movable mask having matching and contrasting elements arranged in a geometric pattern which permits the mask and the light permeable spots to cooperate to define either arabic numerals from 0 through 9, or letters of the alphabet from A to Z. The arrangement of the geometric pattern is such that the length of the mask is substantially less than $LW \times N$, where LW is the layout width and N is the number of characters to be formed.

In the preferred embodiments of the present invention, a housing contains several stacked prefabricated subassemblies, each of which consists of any required number of units side-by-side, with a narrow space between adjacent units, and with narrow spaces between the endmost units and the sides of the housing. A matching and contrasting mask for each unit consists of a flexible film member the ends of which are turned rearwardly through the spaces between the units, and between the housing and the units, so that those spaces provide film receiving slots; and the film members are guided between the front of the housing and the front walls of the units, and rearwardly through the slots.

Preferably the apparatus of the invention has a rectangular layout of rectangular spots arranged in parallel vertical columns. A unit for displaying arabic numerals from 0 to 9 has complete columns of rectangles at the two sides, and interrupted columns between, to form a block number 8, and a numeric film member mask having a particular geometric pattern of matching and contrasting elements cooperates with the block number 8 to define any selected numeral.

For an alphabetic display, the layout of rectangular spots has several complete parallel columns of such spots, and an alphabetic film member mask has a geometric pattern of matching and contrasting elements which are so arranged as to define any selected letter of the alphabet when properly aligned with the layout of rectangular spots on the unit front plate.

An apparatus for a changeable price display has two units for the cents columns, a first unit to the left which includes a light pervious spot forming a decimal point as well as a block number 8 for the units column, and additional units as may be required to indicate prices greater than $9.99 or greater than $99.99, etc.

Apparatus for an alphabetical display has as many units as may be required to spell the longest word which may be displayed. Thus, for example, a display menu in a carry out or fast food service restaurant might require 14 units to spell out "fish and chips". Such an apparatus would probably have, for example, 14 units for the menu and three units for a price display.

The present invention may be utilized in apparatus in which the unit front plate is thin and has a layout of rectangular holes or transparent areas, and the film member is in contact with the rear surface of the unit front plate and has matching elements which are identically the same color as the front plate and contrasting elements which, when seen through the holes or transparent spots, define the characters. In such devices the contrasting elements may be coated with fluorescent ink or other pigment.

In the preferred embodiments hereinafter described in detail and illustrated, each unit of a subassembly constitutes a small light box having a relatively thick forward wall with a layout of rectangular holes; and each film member has opaque matching areas and transparent contrasting areas, and abuts the forward face of the front plate. There is a light source in the rear of the housing which projects light through the light boxes.

The front of the housing consists of an opaque plate which has a rectangular window in front of each light box, and a rigid transparent sheet covering the front plate. At the top of each window is a notch which forms an index element, and each of the film members has small index characters along its upper edge portion so that when a particular character is visible in the index notch the film member is properly positioned to define that character in the window.

When it is necessary to change characters, removal of the transparent sheet permits easy manual manipulation of the film members through the windows to shift them transversely across the faces of the light boxes. Vertically extending ears at the end extremities of the top and bottom margins of the film members prevent the film members from accidentally being pulled out of the slots.

The hereinafter described embodiments of the present invention, utilizing the preferred rectangular openings in the light box front plates, black and untinted transparent film members, a light source such as blue-white fluorescent tubes behind the light boxes, and a transparent rigid cover sheet of pale blue plastic or glass covering the films, generally simulates the appearance of a computer readout of the displayed materials.

THE DRAWINGS

DETAILED DESCRIPTION OF THE INVENTION

Figure 2:
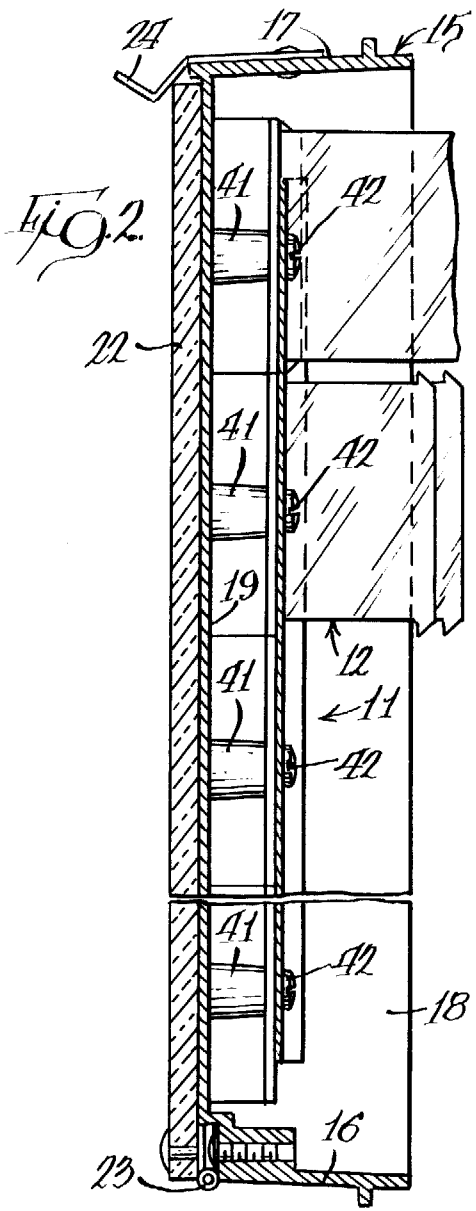
FIG. 2 is a sectional view taken substantially as indicated along the line 2—2 of FIG. 1 with the broken out part restored.
Figure 1:
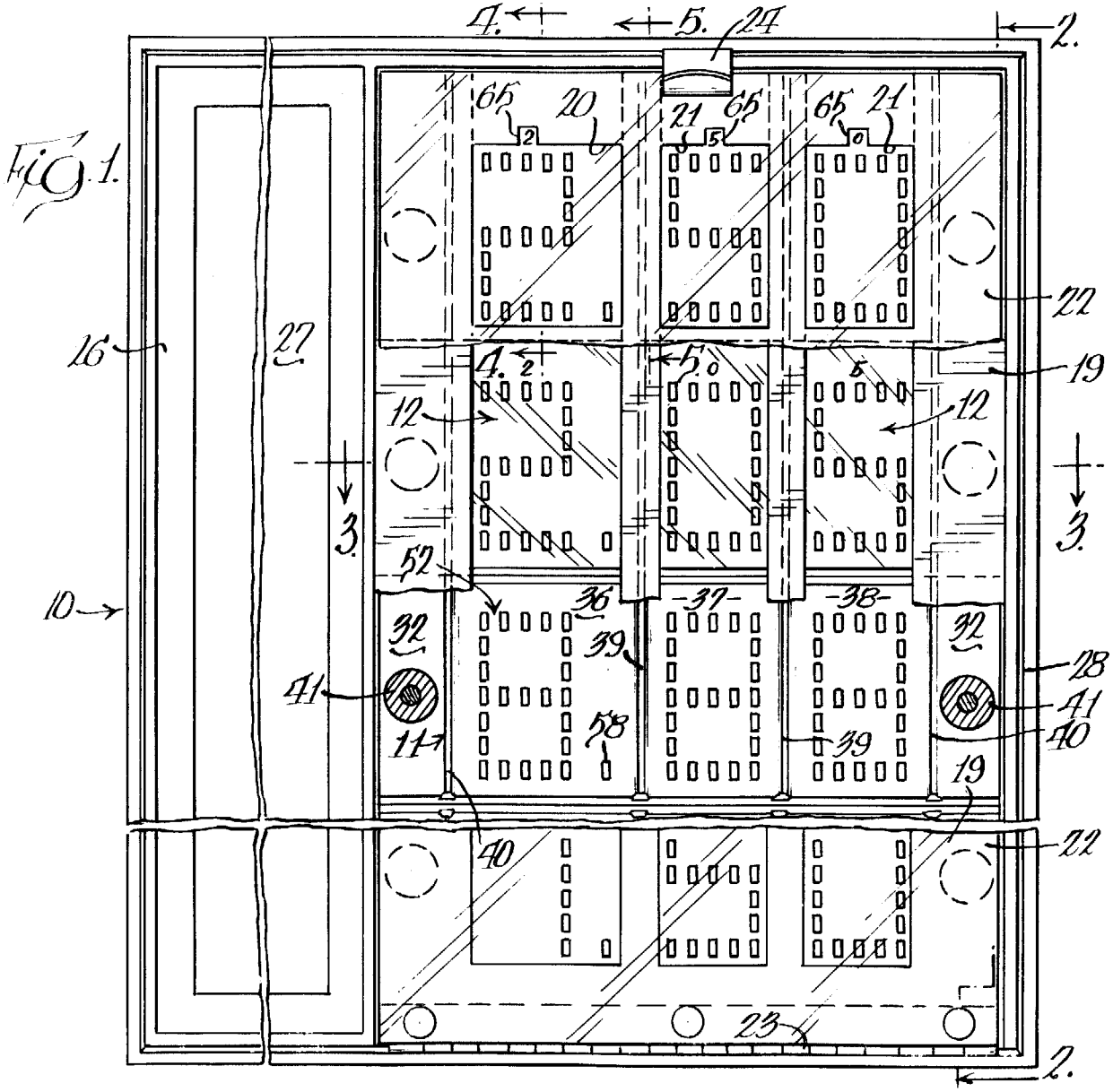
FIG. 1 is a fragmentary, front elevational view of the apparatus of the invention as embodied in a back lighted price display device for prices up to $9.99, with a part of the housing front wall broken away to effectively fully illustrate one of the prefabricated light box subassemblies.
Figures 3, 4, 5:
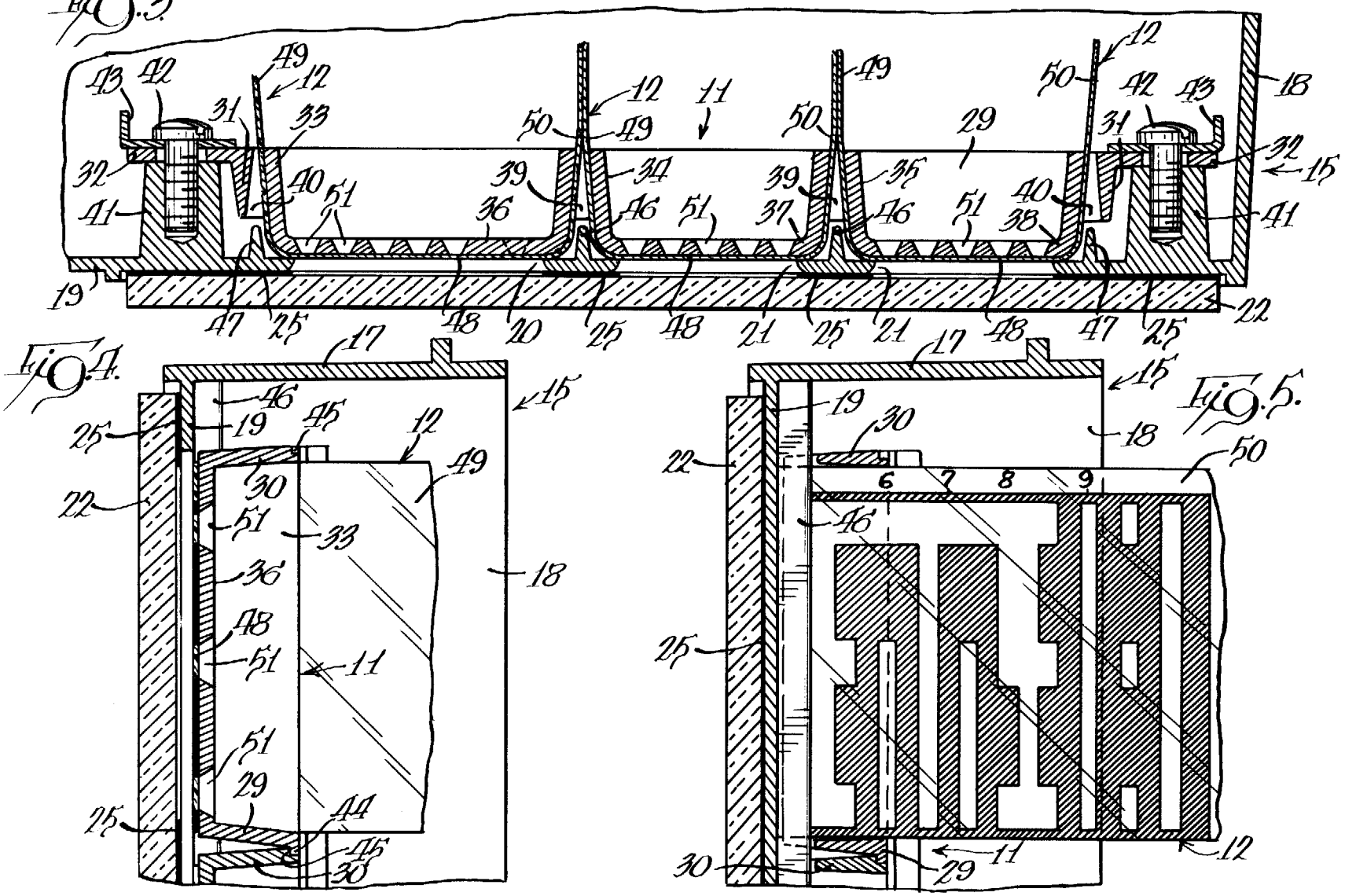
FIG. 3 is a fragmentary sectional view on an enlarged scale taken substantially as indicated along the line 3—3 of FIG. 1.
FIG. 4 is a fragmentary sectional view on the same scale as FIG. 3, taken substantially as indicated along the line 4—4 of FIG. 1.
FIG. 5 is a fragmentary sectional view on the same scale as FIGS. 3 and 4, taken substantially as indicated along the line 5—5 of FIG. 1.

FIGS. 1 and 3 of the drawings expressly illustrate an adjustable, illuminated price display for prices up to $9.99. As previously indicated, for higher prices there must be an additional light box to the left of the three which are illustrated; and in an alphabetic display there must be enough light boxes for the longest word or combination of words that must appear in the display. Such apparatuses only involve a wider housing and a longer prefabricated subassembly as seen in FIG. 3. FIGS. 2, 4 and 5 illustrate light box structures as they may be used in apparatuses having any number of light boxes in a subassembly.

Figures 6, 7, 11:
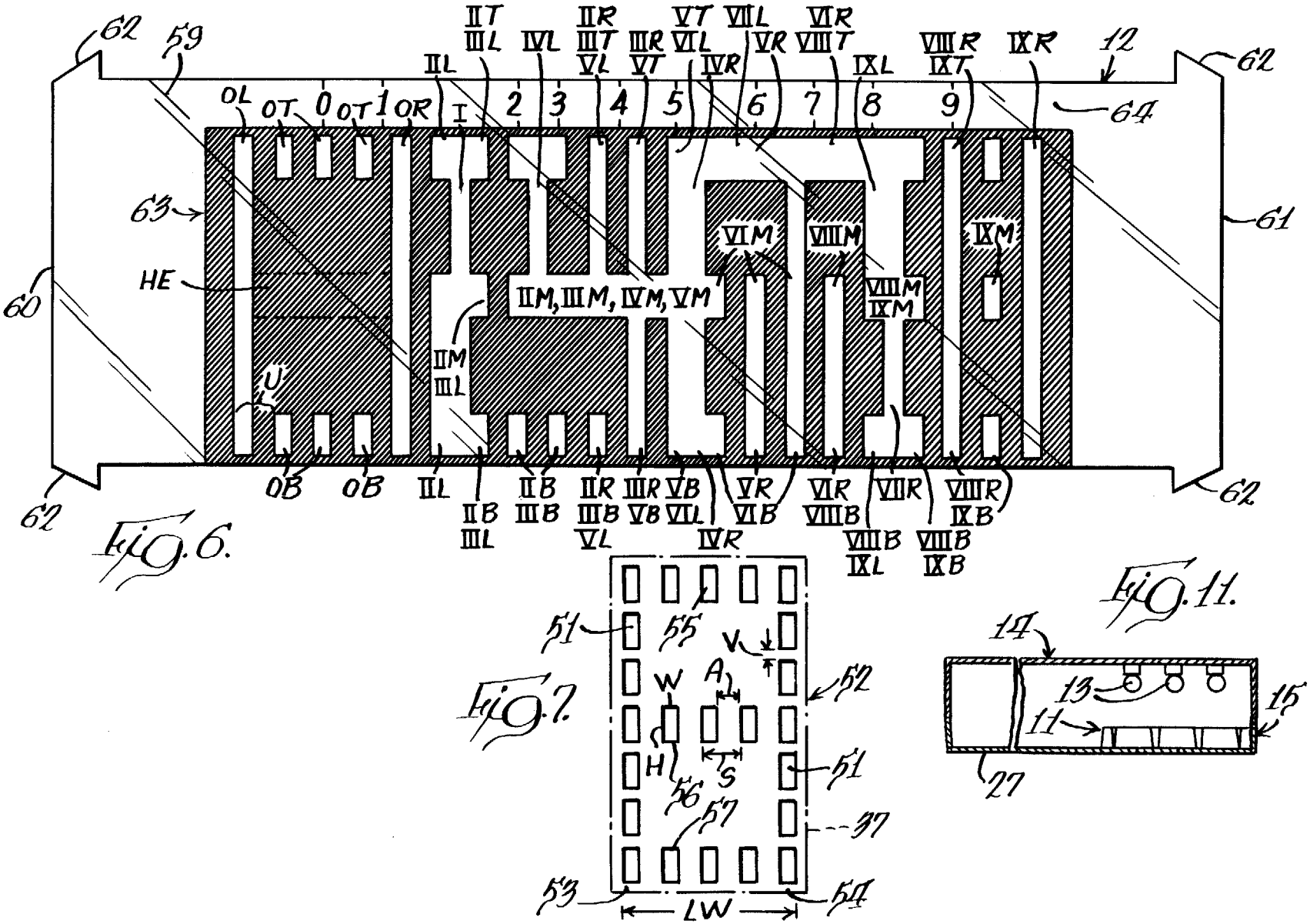
FIG. 6 illustrates a complete numeric film member mask as used in a prototype of the present inventon.
FIG. 7 illustrates the pattern of transparent rectangular spots, or openings in the front plate of a light box with which the numeric film member mask of FIG. 6 is used.
FIG. 11 is a transverse sectional view on a reduced scale illustrating the entire housing and light source.

Referring to the drawings in detail, and referring first to FIGS. 1 and 11, the apparatus of the present invention, as applied to a numeric price display, consists generally of a housing, indicated generally at 10; a stack of prefabricated subassemblies, indicated generally at 11, each of which consists of three light boxes, as will be described in more detail; a film member mask, indicated generally at 12, operatively associated with each light box; and a light source 13 in the housing behind the prefabricated subassemblies. As seen in FIG. 11, the housing 10 consists generally of a rearward shell 14 and a forward shell 15 in which the prefabricated subassemblies 11 are mounted. As best seen in FIG. 2, the forward shell 15 includes generally a bottom wall 16, a top wall 17, sidewalls 18, and a front wall 19 which has windows 20 and 21 in register with each of the light boxes of the prefabricated subassemblies 11. A rigid transparent sheet 22 is mounted at the bottom of the forward shell 15 on a piano hinge 23, and a spring latch 24 at the top of the shell 15 releasably retains the transparent cover sheet 22 in place, while permitting easy access to the film members 12 when it is necessary to change any of the prices indicated by the display. Thin strips of padding 25 are mounted upon the inner face of the transparent sheet 22 where it registers with various parts of the front shell 15.

The transparent front sheet 22 may be tinted to provide any desired visual effect. As previously indicated, a light blue tint causes the numerals of the price display to present much the visual appearance of a computer readout.

As seen in FIG. 1, the left hand side of the front shell 15 is provided with a frame 26 that surrounds an area 27 where the merchandise may be listed for which the prices are indicated by the numerals of the adjustable price display.

Figure 9:
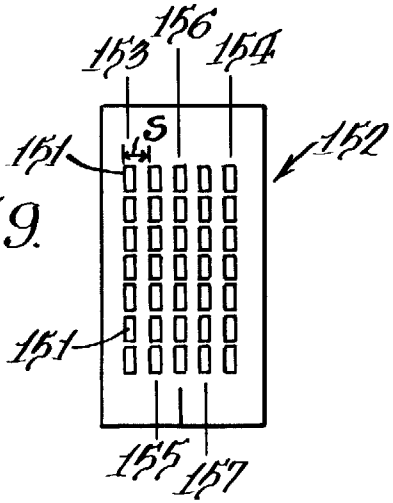
FIG. 9 illustrates the pattern of transparent rectangular spots, or openings in the front plate of a light box with which the alphabetic film member mask of FIG. 8 is used.

An apparatus that utilizes both changeable prices and changeable article listings as here disclosed will, of course, substitute for the area 27 a stack of prefabricated subassemblies like 11, but having a dozen or more light boxes with the hole layout of FIG. 9.

Conveniently, both the rear housing shell 14 and the front housing shell 15 are one piece plastic moldings. To enhance the aesthetic appearance of the device, continuous flanges or beads 28 of any desired shape surround the entire front housing shell 15.

Referring now particularly to FIGS. 2 to 5, each of the prefabricated subassemblies 11 is a plastic molding having a bottom web 29, a top web 30, upright side webs 31 connecting the top and bottom webs, and mounting flanges 32 which extend laterally from the rear portions of the side webs 31. Three shallow, rearwardly open, U-shaped structures 33, 34 and 35 are integral at their lower ends with the bottom flanges 29 and at their upper ends with the top flanges 30; and each of said structures 33, 34 and 35 serves the purpose of a light box which has an opaque forward wall, said forward walls being designated, respectively, as 36, 37 and 38. As best seen in FIG. 3, the adjacent upright sides of the U-shaped structures 33 and 34, and of the U-shaped structures 34 and 35, are closely spaced to provide narrow, upright film receiving slots 39, and the outer upright sides of the members 33 and 35 are spaced slightly from the upright side flanges 31 of the prefabricated subassemblies to provide further narrow, film receiving slots 40. The opaque front wall 19 of the front housing shell 15 has vertically spaced, horizontally aligned pairs of rearwardly extending mounting bosses 41; and the prefabricated subassemblies 11 are stacked one on top of the other with their laterally extending mounting flanges 32 secured to the mounting bosses 41 by means of screws 42 which have their heads seated on thrust washers 43. As best seen in FIG. 4, the bottom web 29 of each of the prefabricated subassemblies has a depending lip 44 which engages a complementary notch 45 in the top web 30 of the subassembly next below it.

As also seen in FIG. 3, the opaque front wall 19 of the forward housing shell 15 has rearwardly extending, tapered vertical ribs 46 which extend into the film receiving slots 39, and similar ribs 47 which extend into the film receiving slots 40; and said ribs cooperate with the adjacent upright sides of the U-shaped structures 33, 34 and 35 to form film member guides. Thus, each film member 12 has a central part 48 which lies against the front wall of the associated light box, and has left and right lateral extremities 49 and 50, respectively, which are turned rearwardly through the film receiving slots by the guides. The guides retain the parts 48 of the film members effectively in contact with the light box front walls to eliminate any visual aberrations which might be caused by space between the film members and said front walls. In addition, the bottom web 29 and top web 30 guide the film members 12 and maintain them in proper vertical register with the light box front walls.

Referring now particularly to FIGS. 1, 3, 4 and 7, each of the light box front walls 36, 37 and 38 is provided with transparent spots in the form of rectangular holes 51 arranged in a rectangular layout forming a block arabic number 8, indicated generally by the reference numeral 52 in FIG. 7. The arabic number 8 has a left side strip 53 consisting of a complete vertical column of seven rectangular holes 51; a right side strip 54 consisting of a complete vertical column of seven holes 51; and three interrupted vertical columns between 53 and 54 which form top, median and bottom connecting strips 55, 56 and 57, respectively. As seen in FIG. 7, each hole 51 has a height H and a width W; and there is an opaque area of a width A between laterally adjacent rectangular holes 51; so there is a span $S=W+A$, between corresponding sides of adjacent holes 51. In addition, there is a vertical space V between the adjacent holes 51 in each of the two columns of holes 53 and 54.

In a prototype of the apparatus of the present invention, the dimensions are as follows:
H=10/32" (5/16"); W=4/32" (⅛"); A=7/32";
S=11/32"; V=3/32"; H+V=13/32".

Referring again to FIG. 1, it is seen that the light box 33 has a front wall 36 which is wider than are the front walls 37 and 38 of the light boxes 34 and 35. This is so a rectangular hole 58 for a decimal point (FIG. 1) may be positioned between the block number 8 of the left hand box 33 and the block number 8 of the middle box 34.

Referring now to FIG. 6, the film member 12 which provides a mask cooperating with the block number 8 of each light box consists of a flexible sheet 59 which may be standard photographic film, or may be a polyester film such as DuPont's Mylar. The flexibility of the film member must, of course, be such that it may be guided around the rounded upright front margins of the light boxes in the manner illustrated in FIG. 3 without cracking or excessive strain which could lead to early failure. The sheet 59 has a left hand end 60 and a right hand end 61; and at the two ends are top and bottom ears 62 which are engaged by the bottom webs 29 and top webs 30 of the prefabricated subassemblies to limit lateral movement of the film members.

Most of each film member 12 is occupied by a geometric pattern 63 of vertical and horizontal opaque and transparent elements which cooperate with the rectangular openings 51 of the block number 8 to define any desired arabic numeral from 0 through 9. The film member 12 has a transparent upper marginal strip 64, above the geometric pattern 63, which is provided with arabic index numerals 0 through 9. Each of the windows 20 and 21 of the forward shell front wall 19 is provided with an index element in the form of a notch 65 (see FIG. 1); and when a particular index numeral in the strip 64 is visible through the index notch 65, the geometric pattern 63 of the film member 12 is registered in such a way with the associated block number 8 as to define the indicated arabic numeral as illustrated in FIG. 1 of the drawings.

The transparent elements of the geometric pattern 63 are identified in FIG. 6 to relate them to the corresponding parts of the various arabic numerals from 0 through 9 which they define when aligned with the vertical columns or horizontal strips of the block number 8. With the exception of the transparent elements for defining the arabic numeral 0, the various transparent elements are identified by roman numerals which correspond to the arabic numerals. Further, the letter L designates the transparent elements that define the left side of an arabic numeral; the letter R designates the transparent elements that define the right side of an arabic numeral; the letter T designates the transparent elements that define the top of an arabic numeral; the letter M designates the transparent elements that define the median part of an arabic numeral; and the letter B designates the transparent elements that define the bottom of the arabic numeral.

Thus, for example, the arabic numeral 0 is defined by the element OL overlying the left hand column 53 of rectangular openings 51, by the element OR overlying the right hand column 54 of rectangular openings 51; by the three rectangular transparent elements OT which overlie the three rectangular openings 51 in the top horizontal strip 55 of the block number 8; and by the three rectangular transparent elements OB which overlie the rectangular openings 51 of the bottom connecting strip 57 of the block number 8. The entire central area between the elements OL and OR and the elements OT and OB is opaque; and specifically that portion between the broken lines of FIG. 6 forms an opaque horizontal element HE which obscures the three rectangular openings 51 of the median connecting strip 56 of the block number 8.

Similarly, the other arabic numerals from 1 through 9 are defined by the various elements of the film member 12 which are identified by corresponding roman numerals in FIG. 6. Thus, when the arabic index number 1 is aligned with an index notch 65, the vertical transparent element I is in register with the right hand column 54 of rectangular holes 51 in the block number 8. With the film member 12 in this position, the vertical transparent element OL and the left hand ones of the elements OT and OB are completely to the left hand vertical column 53 of the number 8; the center transparent elements OT and OB and the right hand transparent elements OT and OB, together with the right hand element OR are all aligned with the opaque areas A between the rectangular openings 51; and accordingly the rectangular openings 51 of the left hand column 53 and of the horizontal top and bottom connecting strips are concealed by the opaque elements which are between the transparent elements OT and between the transparent elements OB, and by the opaque element which is immediately to the right of the transparent element OR.

It is believed that the foregoing analysis of the relative positions of the transparent openings 51 and of the opaque and transparent elements of the film member 12 which occur in defining the arabic numerals 0 and 1 need not be repeated for all of the remaining arabic numerals from 2 through 9. Suffice it to say that in each case the transparent elements are aligned with the complete columns of openings 53 and 54 and with the lines of openings 55, 56 and 57 as indicated by the roman numerals and letters on FIG. 6.

Wherever two or more roman numerals in FIG. 6 appear one below the other in association with a single lead line, it indicates that the particular transparent element identified by that lead line is aligned with an opening 51 to define the identified part of each of the identified numerals. Thus, the transparent blocks which extend to the right of the element I serve to form part of the top, median and bottom parts of the arabic numeral 2, and also serve to form the left-most extremities of the arabic numeral 3. Correspondingly, the long transparent median bar which carries the reference indicia IIM, IIIM, IVM, VM and VIM serves to define the median parts of all of those numerals.

Referring to the lower left hand portion of the geometric pattern 63, there is a bracket which spans the transparent element OL and the opaque element between the element OL and the adjacent element OB; and the bracketed span is identified as U. This represents a unit of the geometric pattern 63; and the width U of each unit is equal to the span S (W+A) of the number 8. As is apparent from FIG. 6, some of the units U are entirely transparent, some are entirely opaque, and some are partly transparent and partly opaque. Each transparent element is 5/32" wide; and each opaque element is 6/32" wide, making the total of 11/32" which is equal to the span S. However, it is to be noted that each transparent element is 1/32" wider than the openings 51; and each opaque element is 2/32" wider than the openings 51 and 1/32" narrower than the opaque area A between openings. Thus, there is a tolerance of at least 1/64" each way from the center line in aligning the transparent elements of the film member 12 and the opaque elements of the film member 12 with the rectangular openings 51 of the number 8.

The depth, or height, of each of the horizontal opaque or transparent elements of the film member 12 is slightly greater than H and less than H+V. Specifically, in the prototype heretofore referred to the height, or depth of the horizontal elements is 12/32" (⅜).

Were it not for the multiple utilization of many of the transparent elements of the geometric pattern 63, the total width of the pattern would necessarily be greater than 10×LW (FIG. 7), which is the layout width. By reason of such multiple utilization the total width of the pattern is about 5×LW; or about LW×½N, where N is the number of characters which can be defined by the apparatus.

Figure 8:
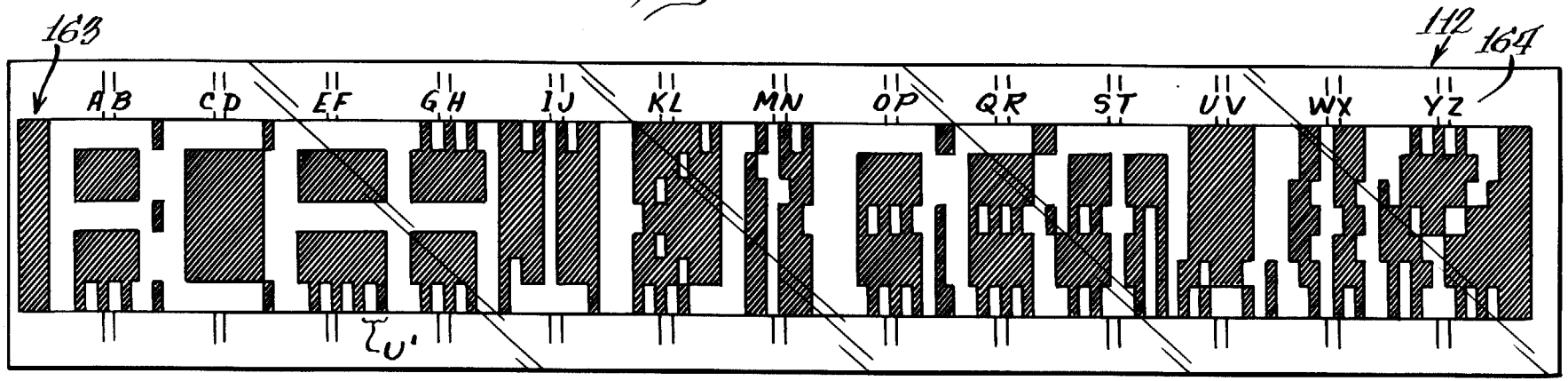
FIG. 8 illustrates a complete alphabetic film member mask as used in a prototype of the present invention.
Figure 10:
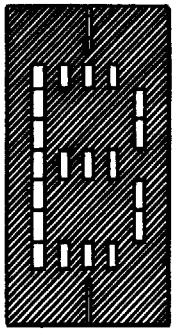
FIG. 10 shows a letter B as formed by the unit.

Referring now to FIGS. 8 to 10, the reference numeral 112 indicates generally a film member having a geometric pattern, indicated generally at 163, which cooperates with a rectangular layout 152 formed in the front of a light box unit which is a part of a prefabricated subassembly, such as the subassemblies 11, and which is like one of the U-shaped structures 34 or 35 except for the fact that a rectangular layout 152, with which the geometric pattern 163 cooperates to define the letters of the alphabet, is as illustrated in FIG. 9, rather than being a block number 8 as in FIG. 7. Thus, the rectangular layout 152 has rectangular holes 151 arranged in five complete columns consisting of a left side column 153, a right side column 154, and intermediate complete columns 155, 156 and 157 which replace the interrupted vertical columns, defining the connecting strips of the block number 8 of FIG. 7.

The film member 112 has a transparent upper marginal strip 164 which is provided with index letters from A through Z. Each of the index letters cooperates with an index notch 65, so that when a particular index letter in the strip 164 is visible through the index notch 65, the geometric pattern 163 of the film member 112 is registered in such a way with the associated rectangular layout of rectangular openings 151 as to define the indicated letter as illustrated in FIG. 10 for the letter B.

The geometric pattern 163 for defining the letters of the alphabet is sufficiently complex that it is considered impractical to relate the various transparent elements of the pattern to the corresponding parts of the various letters, as was done for the numerals in FIG. 6. It is believed sufficient to state that the geometric pattern illustrated in FIG. 8 is precisely that of a prototype apparatus which has been used with a rectangular layout such as the layout 152, to exactly the scale illustrated in the drawings, in an apparatus that defines all the letters of the alphabet from A to Z.

The difference in scale between FIGS. 6 and 7 and FIGS. 8 and 9 is illustrative of the fact that a commercial device embodying the invention can be made to practically any desired scale, depending upon the distance from which the alphabetic or numeric display is to be viewed.

In any case, the geometric pattern 163 has units U', one of which is bracketed at the bottom of that part of the pattern below and to the right of the index letter F; and the width of each unit is equal to a span S' which is the combined width of a rectangular opening 151 and the adjacent opaque area between such openings. Also, as is the case with the numeric geometric pattern 63, each transparent element and each opaque element of the geometric pattern 163 is slightly wider than one of the openings 151.

Accordingly, although the layout 152 and the layout 52 are different from one another, and although the geometric pattern 163 and the geometric pattern 63 are quite different from one another because of their different purposes, the same relative dimensional relationships between the geometric pattern elements and the rectangular layout openings is maintained in both devices. In addition, FIG. 8 illustrates only so much of the film member 112 as is necessary to illustrate the entire geometric pattern 163. A film member for use in an alphabetic display has more extended left and right extremities, similar to those of the numeric film member 12, and is provided with ears like the ears 62 to prevent the film member from being disengaged from the light box on which it is mounted.

Multiple utilization of many of the transparent elements of the geometric pattern 163 permits the total width of the pattern to be about 15 times the width of the layout 152; or about 57% of the minimum width that would be required were it not for multiple utilization of such transparent elements.

The foregoing detailed description is given for clearness of understanding only and no unnecessary limitations should be understood therefrom, as modifications will be obvious to those skilled in the art.

I claim:

1. In a device for selectively displaying arabic numerals from 0 through 9, said device being of the type which includes a light box having an opaque front plate with transparent portions forming a number 8 that has parallel upright left and right side strips and parallel horizontal top, median and bottom connecting strips, each of said side strips comprising a column of transparent spots separated by opaque areas, and each of said horizontal strips comprising a horizontal line of transparent spots separated by opaque areas, the improvement comprising:

a flexible unstressed film member having a geometric pattern of vertical and horizontal opaque and transparent elements which may be used in cooperation with the transparent front plate spots to define any desired arabic numeral from 0 through 9 by moving the film member laterally across the front plate to align a selected part of said film member with said number 8, several of said opaque and transparent elements cooperating with the front plate spots to define parts of more than one numeral, whereby the length of the geometric pattern is considerably less than ten times the width of the number 8 on the front plate;

and guide means including spaced rearwardly extending side walls on said light box for positioning said film member with the part thereof for defining a selected arabic numeral against the front plate and with the parts of the film member at the two sides of said selected part bent rearwardly at the sides of the light box and lying in planar fashion along the outer faces of said sidewalls.

2. The improvement of claim 1 which includes an index element operatively associated with the front plate, and arabic index numerals from 0 through 9 on the film member alignable with said index element to visually indicate when there is proper alignment of a selected part of the film member with the transparent strips to define the desired numeral.

3. The improvement of claim 1 in which each transparent spot is a rectangle, and the opaque areas separating the rectangles in each horizontal line are between 1.5 and 2 times as wide as the rectangles.

4. The improvement of claim 3 in which the length of the geometric pattern on the film member is between 4.5 and 5 times the width of the number 8.

5. The improvement of claim 3 in which the film member has opaque and transparent elements for defining the arabic numeral 0 near its left end, the numeral 1 is defined by a transparent vertical element that aligns with the vertical right side strip of the number 8 and by certain of the opaque elements for defining the numeral 0 which mask all the transparent spots except those in said right side strip, and the elements for defining the numerals are arranged in order from 0 to 9.

6. The improvement of claim 5 in which the maximum lateral movement of the film member from the position for defining a numeral to the position for defining the next adjacent numeral is about 80% of the width of the number 8.

7. The improvement of claim 6 in which the minimum lateral movement of the film member from the position for defining a numeral to the position for defining the next adjacent numeral is between 20% and 25% of the width of the number 8.

8. The improvement of claim 7 in which the length of the geometric pattern on the film member is between 4.5 and 5 times the width of the number 8.

9. The improvement of claim 1 in which the film member has vertically extending top and bottom ears at its ends, and said ears cooperate with the guide means to limit lateral movement of the film member.

10. The improvement of claim 1 in which all the transparent spots of the light box are rectangles of height H and width W, separated by opaque areas of width A which is slightly greater than W, so that a span S from a side of one rectangle to the corresponding side of the next adjacent rectangle is slightly greater than 2 W, in which the opaque and transparent elements of the film member consist of laterally adjacent units U each of which has a width equal to S, some of said units being wholly transparent, some being wholly opaque, and some being partly transparent and partly opaque, and in which there are horizontal bars consisting of multiple transparent units and multiple opaque units in register with the rectangles of the light box horizontal connecting strips.

11. The improvement of claim 10 in which there are three rectangles in each horizontal line, between the columns of rectangles forming the left and right strips.

12. The improvement of claim 10 in which the width of each vertical opaque element and of each vertical transparent element is greater than W and less than A.

13. The improvement of claim 11 in which a vertical space V between adjacent rectangles in a column is a fraction of H, and the height of each horizontal bar is between H and H+V.

14. In a device for selectively displaying prices of articles, the improvement comprising:

a prefabricated subassembly comprising three transversely aligned, immediately adjacent light boxes each of which has an opaque front plate with transparent portions forming a number 8 that has parallel upright left and right side strips and parallel horizontal top, median and bottom connecting strips, each of said side strips comprising a column of transparent spots separated by opaque areas, and each of said horizontal strips comprising a horizontal line of transparent spots separated by opaque areas, and the left-hand one of said three light boxes having a transparent spot defining a decimal point at the lower right-hand part of said box, said light boxes having rounded upright side margins and shallow sidewalls, and the sidewalls of a center one of said boxes being slightly spaced from the adjacent sidewalls of the flanking boxes to provide upright film receiving slots;

a housing which has upright side frame elements, said subassembly being secured in said housing with the outer sidewalls of the flanking boxes close to said side frame elements to define a narrow upright film receiving slot at each side of said subassembly;

three flexible unstressed film members, one operatively associated with each light box, each of said film members extending across the front plate of one light box and having end portions received in said slots, each of said film members having a geometric pattern of vertical and horizontal opaque and transparent elements which may be selectively aligned with the transparent front plate spots to define any arabic numeral from 0 through 9 by moving the film member laterally across the front plate, several of said opaque and transparent elements cooperating with the front plate areas to define parts of more than one numeral, whereby the length of the geometric pattern is considerably less than ten times the width of the number 8 on the front plate of a light box;

guide means on the housing operatively associated with each of said three film members for positioning each film member with the part thereof for defining a selected arabic numeral against the front plate of the associated light box and the parts of the film member at the two sides of said selected part extending rearwardly through the film receiving slots at the sides of the associated light box and lying in planar fashion along the sidewalls of said associated light box;

and a light source in said housing behind the prefabricated subassembly.

15. The improvement of claim 14 in which a second prefabricated subassembly identical with said subassembly of claim 14 is supported on said latter subassembly and secured in the housing, in which three additional film members identical to those of claim 14 are operatively associated with said second subassembly, and in which the guide means on the housing also positions said three additional film members.

16. The improvement of claim 15 which includes an index element operatively associated with the front plate of each light box, and arabic index numerals from 0 through 9 on each film member alignable with the associated index element to visually indicate when there is proper alignment of a selected part of each film member with the transparent strips to define the desired numeral.

17. The improvement of claim 16 in which the housing includes an opaque front plate with a window in front of each light box, each said window having a margin with a notch which forms the index element for the associated light box, and a rigid transparent sheet covering said front plate.

18. The improvement of claim 14 in which the housing includes an opaque front plate with a rectangular window in front of each light box, said windows having upright margins which form part of the guide means, and in which a rigid transparent sheet covers the front plate.

19. In a device for selectively displaying alphabetic or numeric characters, the improvement comprising, in combination:

an opaque front plate with a rectangular layout of light permeable spots arranged in a plurality of parallel, vertical columns separated by opaque areas;

a flexible, unstressed film member having a geometric pattern of vertical and horizontal matching elements which visually match the opaque areas, and visually contrasting elements, said elements being adapted to be used in cooperation with the light permeable front plate spots to define any desired character by moving the film member laterally across the front plate to align a selected part of said film member with said rectangular layout, several of said matching and contrasting elements cooperating with the front plate spots to define parts of more than one character, whereby the length L of the geometric pattern is considerably less than N times LW, where LW is the width of the layout and N is the number of characters to be formed by the apparatus;

and guide means including spaced, rearwardly extending sidewalls for positioning said film member with the part thereof for defining a selected character against the front plate and with the parts of the film member at the two sides of said selected part bent rearwardly at the sides of the front plate and lying in planar fashion along the outer faces of said sidewalls.

20. The improvement of claim 19 which includes an index element operatively associated with the front plate, and an index character on the film member for each character to be defined, each said index character being alignable with said index element to visually indicate when there is proper alignment of a selected part of the film member with the layout of light permeable spots to define the desired character.

21. The improvement of claim 19 in which each transparent spot is a rectangle, and the opaque areas separating the rectangles in each horizontal line are between 1.5 and 2 times as wide as the rectangles.

22. The improvement of claim 21 in which there are two complete columns of rectangles at the two sides of the rectangular layout and several interrupted columns having only a top rectangle, a median rectangle and a bottom rectangle so the layout is a block number 8 and in which the film member pattern is adapted to define arabic numerals from 0 to 9, and L is between 4.5 and 5 times LW.

23. The improvement of claim 22 in which the film member has matching and contrasting elements for defining the arabic numeral 0 near its left end, the numeral 1 is defined by a contrasting vertical element that aligns with the vertical right side strip of the number 8 and by certain of the matching elements for defining the numeral 0 which mask all the light pervious spots except those in said right side strip, and the elements for defining the numerals are arranged in order from 0 to 9.

24. The improvement of claim 21 in which the layout consists of several uninterrupted columns of rectangles, and in which the film member pattern is adapted to define the 26 letters of the English alphabet and L is between 15 and 16 times LW.

25. The improvement of claim 24 in which the film member has matching and contrasting elements for defining the letter A near its left end, and the elements for defining the remaining letters are arranged in order from left to right.

26. The improvement of claim 19 in which the layout consists of several uninterrupted columns of transparent spots, and in which the film member pattern is adapted to define the 26 letters of the English alphabet and L is between 15 and 16 times LW.

27. The improvement of claim 26 in which front plate is the front of a light box, the film member has matching elements which are opaque and contrasting elements which are transparent, and the film member overlies the front of the front plate.

28. The improvement of claim 19 in which all the light permeable spots of the front plate are rectangles of height H and width W, separated by opaque areas of width A which is slightly greater than W, so that a span S from a side of one rectangle to the corresponding side of the next adjacent rectangle is slightly greater than 2 W, in which the matching and contrasting elements of the film member consist of laterally adjacent units U each of which has a width equal to S, some of said units being wholly contrasting, some being wholly matching, and some being partly contrasting and partly matching.

29. The improvement of claim 28 in which there are five columns of light permeable spots forming the rectangular layout.

30. The improvement of claim 28 in which the width of each matching element and of each contrasting element is greater than W and less than A.

31. The improvement of claim 28 in which there are two complete columns of rectangles at the two sides of the rectangular layout and several interrupted columns having only a top rectangle, a median rectangle and a bottom rectangle so the layout is a block number 8 and in which the film member pattern is adapted to define arabic numerals from 0 to 9.

32. The improvement of claim 24 in which the layout consists of several uninterrupted columns of rectangles, and in which the film member pattern is adapted to define the 26 letters of the English alphabet.

33. In a device for selectively displaying characters to convey alphabetical or numeric information respecting articles, the improvement comprising:

a prefabricated subassembly comprising several transversely aligned, immediately adjacent light boxes each of which has an opaque front plate with a rectangular layout of light permeable spots arranged in a plurality of parallel vertical columns, said light boxes having rounded upright side margins and shallow sidewalls, and the sidewalls of adjacent light boxes being slightly spaced from one another to provide upright film receiving slots;

a housing which has upright side frame elements, said subassembly being secured in said housing with the outer sidewalls of the boxes at the ends of the subassembly close to said side frame elements to define a narrow upright film receiving slot at each side of said subassembly; a separate flexible unstressed film member operatively associated with each light box, each of said film members extending across the front plate of one light box and having end portions received in said slots, each of said film members having a geometric pattern of vertical and horizontal opaque and transparent elements which may be selectively aligned with the transparent front plate spots to define any desired character by moving the film member laterally across the front plate, several of said opaque and transparent elements cooperating with the front plate areas to define parts of more than one character, whereby the length L of the geometric pattern is considerably less than N times LW, where LW is the width of the layout on the front plate of a light box and N is the number of characters to be formed by one light box and film member;

guide means on the housing operatively associated with each of said three film members for positioning each film member with the part thereof for defining a selected character against the front plate of the associated light box and the parts of the film member at the two sides of said selected part extending rearwardly through the film receiving slots at the sides of the associated light box and lying in planar fashion along the sidewalls of said associated light box.

34. The improvement of claim 33 in which a second prefabricated subassembly identical with said subassembly of claim 33 is supported on said latter subassembly and secured in the housing, in which an additional film member identical to those of claim 33 is operatively associated with each light box in said second subassembly, and in which the guide means on the housing also positions each of said additional film members.

35. The improvement of claim 34 which includes an index element operatively associated with the front plate of each light box, and an index character on each film member for each character to be defined, each of said index characters being alignable with the associated index element to visually indicate when there is proper alignment of a selected part of each film member with the layout of light permeable spots to define the desired character.

36. The improvement of claim 35 in which the housing includes an opaque front plate with a window in front of each light box, each said window having a margin with a notch which forms the index element for the associated light box, and a rigid transparent sheet covering said front plate.

37. The improvement of claim 33 in which the housing includes an opaque front plate with a rectangular window in front of each light box, said windows having upright margins which form part of the guide means, and in which a rigid transparent sheet covers the front plate.

* * * * *